US005364262A

United States Patent [19]

Phillips

[11] Patent Number: 5,364,262

[45] Date of Patent: Nov. 15, 1994

[54] APPARATUS FOR THE EARLY DETECTION AND RELIEF OF UNSAFE CONDITIONS IN A GASEOUS SYSTEM

[76] Inventor: Douglas E. Phillips, Post Office Box 348, Springville, Calif. 93265

[21] Appl. No.: 7,724

[22] Filed: Jan. 22, 1993

[51] Int. Cl.[5] ..... F23D 14/00

[52] U.S. Cl. ..... 431/202; 431/5; 431/18; 431/22; 431/356; 62/45.1

[58] Field of Search ..... 431/202, 2, 5, 6, 22, 431/12, 18, 38, 44, 346, 356; 422/182, 183; 62/46.1, 45.1, 48.1, 48.4, 53.2, 54.3, 54.2

[56] References Cited

U.S. PATENT DOCUMENTS 3,887,325 6/1975 Finger ..... 431/6
3,999,936 12/1976 Hasselmann ..... 431/202
4,619,225 10/1986 Lowther ..... 123/3
4,750,454 6/1988 Santina et al. ..... 123/3
4,943,190 7/1990 Dewrtz ..... 406/134

*Primary Examiner*—Larry Jones
*Attorney, Agent, or Firm*—Dennis B. Haase

[57] ABSTRACT

A method and apparatus for the early detection and relief of a closed, pressurized gas charged system, such as an ammonia refrigeration system, wherein a central control system measures and assimilates system and ambient conditions, and responds to alleviate system pressures in excess of design parameters, and, further, combusts system gasses so relieved, breaking such gasses into nontoxic byproducts of combustion.

14 Claims, 2 Drawing Sheets

60
81
82
64
62
66
43
70
45
75
68
NH3
80
77
40
36
59
57
55
53
47
49
50
51
20
Control
Battery
72
C3H8

APPARATUS FOR THE EARLY DETECTION AND RELIEF OF UNSAFE CONDITIONS IN A GASEOUS SYSTEM

BACKGROUND OF THE INVENTION

The present invention relates generally to the prevention of destructive conditions in gas driven systems, where the gaseous medium is toxic, or explosive, or both. More particularly, the invention relates to means for detecting the onset of system conditions which are potentially dangerous to the integrity of a gaseous system, and relieves those conditions before a rupture or other disaster to the system results.

There are several gas driven systems in both commercial and consumer use. Cooling systems, and particularly commercial refrigeration systems, are predominantly pressurized gas driven, and ammonia is the current coolant of choice for such systems. However, free ammonia is considered toxic, and when used in a refrigeration system where expansion and compression of the gaseous medium is constantly taking place, the opportunity for breach of the system, with the concurrent escape of toxic gasses, is great.

By way of example, one need only consider the stress placed on such a system when ambient temperatures are driven into high ranges, such as by explosion or fire. Pressures in the system are quickly driven upwardly, and potentially beyond the design parameters of the system itself. Depending on the gaseous medium, a rupture of the system could have calamitous results. Similar problems can result from seismic disturbances. It is such problems that the present .invention attempts to address.

OVERVIEW OF THE PRIOR ART

Prior the advent of the present invention, the industry's standard approach to the problem of build-up of potentially dangerous conditions, was to simply relieve gas pressure to the atmosphere when it exceeded predetermined levels. Relief valves of a variety of known configuration are in use, all of which have one common characteristics i.e., pressure is relieved by expelling a quantity of the gaseous medium to the atmosphere.

Increasingly stringent environmental, fire, and safety codes and regulations, however, have made such simplistic approaches significantly less than acceptable.

SUMMARY OF THE INVENTION

The present invention introduces to the industry what is believed to be the first system to provide early detection of potentially dangerous conditions in a pressurized gas driven system resulting from unexpected, and typically rapid, changes in ambient conditions, or component failure, and to automatically provide for controlled system relief, including combined cool down and vented pressure relief to minimize the chances of a system breach.

It is another objective of the present invention to provide system-wide monitoring of system parameters, and to respond rapidly and automatically to potentially dangerous conditions by controlled relief of the system to stabilize it against possible breach.

Still another objective is to permit controlled purging of system gasses sufficient to maintain the system within design parameters, and ancillary to this objective is the system's capacity to cause release of system gasses into the atmosphere in a nontoxic, environmentally acceptable form.

DESCRIPTION OF THE DRAWINGS

With the foregoing provided as the environmental setting for the apparatus of the present invention, details of the apparatus are further provided by the accompanying drawings, wherein.

DETAILED DESCRIPTION OF A PREFERRED EMBODIMENT

Figure 1:
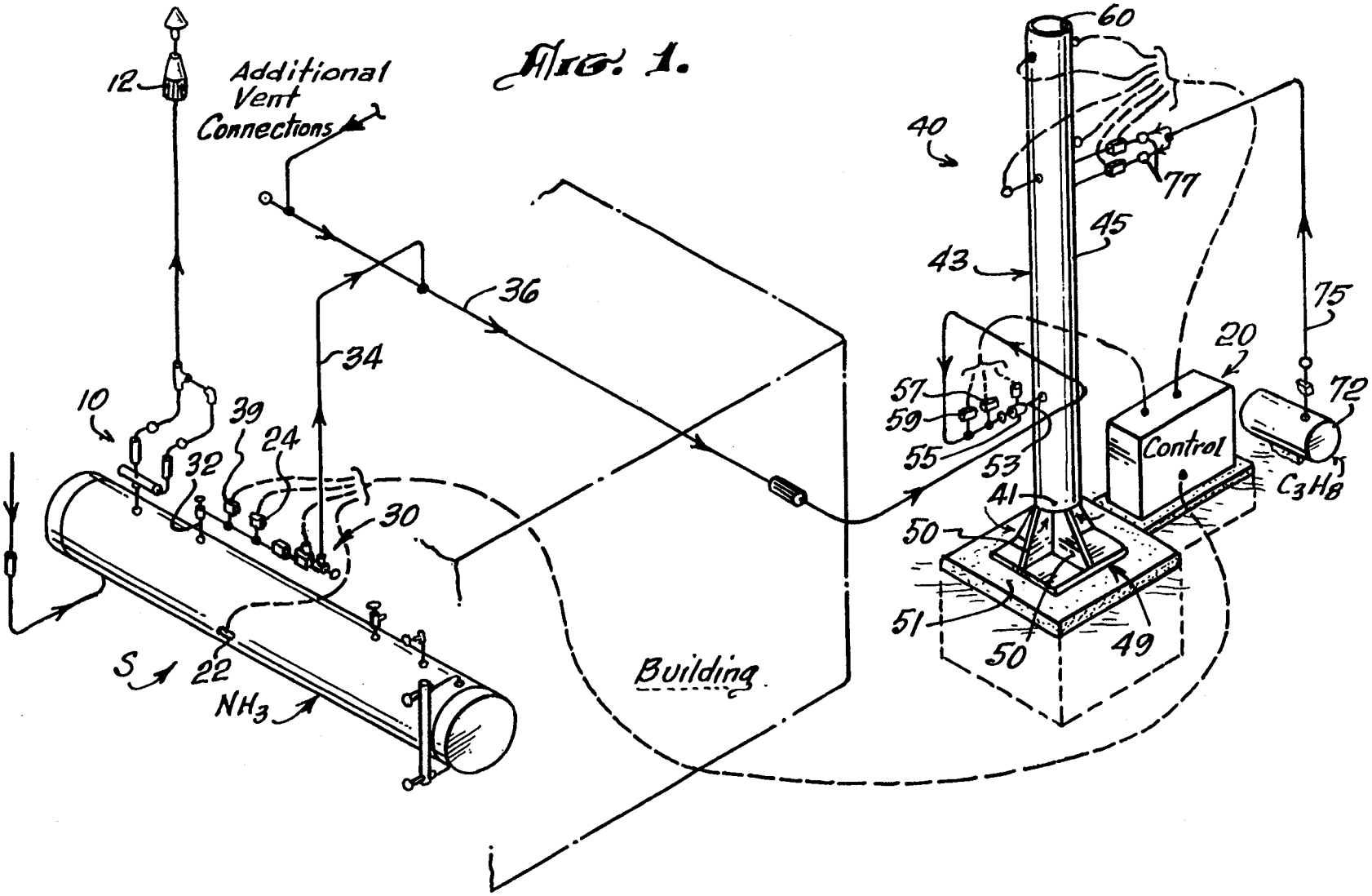
FIG. 1 is a pictorial view of the system of the present invention shown in conjunction with an ammonia cooling system, with its various operative elements shown in their relative alignment.

With reference now to the drawings, and initially to FIG. 1, a typical ammonia refrigeration system is symbolically shown by way of its ammonia receiving tank S, an integral part of the system as a whole, and that portion in which the gaseous medium, in the illustrated case, ammonia, is accumulated and stored under pressure. For that reason, it is the area within the refrigeration system which is most susceptible to monitoring of the system's response to ambient conditions.

The pressure vessel S is fitted with a typical relief valve assembly 10, which is vented to atmosphere through, in this illustrative case, an ammonia defuser device 12, of well known construction. This rather primitive purging system, although clearly inadequate, is required by most codes and regulations governing the installation and operation of such facilities.

The early detection and relief system of the present invention, which is a quantum leap forward from that just discussed, has, as its heart and brain, a control unit 20, which data is accumulated, assimilated, analyzed and appropriate responses are initiated, as will be detailed hereinafter.

The control unit is equipped with a computer which is programed to receive data from an array of strategically placed sensors, such as temperature sensor 22, which monitors the temperature on the surface of the pressure vessel. A pressure transducer 24 is also provided to monitor operating pressures in the pressure vessel. The computer is capable of responding to date received to control the operating parameters of the system, such as by releasing system gasses.

It will be appreciated that several pressure and temperature sensing elements may be used in a variety of sensitive areas of the refrigeration system, depending on the particular design, and the description offered here is intended to illustrate, rather than limit, the scope of the invention.

Under circumstances where a system failure is likely to occur, it is not uncommon for there also to be an external power failure. For that reason, the control unit 20, in keeping with this aspect of the invention, includes a power reservoir and/or backup. It is contemplated, for example, that an APU of known construction may be provided, which is activated in response to loss of line power to the unit. Storage of auxiliary power may also be used singly, or in conjunction with an APU without departure from the invention.

In the same context, the control unit is located, in accordance with another aspect of the invention, in a place which is remote from the refrigeration system, so as to be unaffected and uncompromised by adverse conditions at the site.

A primary asset of the system of the present invention, is that it not only detects the onset of adverse ambient and/or system conditions, but quickly responds to such adverse conditions to relieve or alleviate the consequences of such conditions within the refrigeration system before a breach of the system, with all of its dangerous ramifications, occurs.

In a gas driven system, in which the gas is under pressure and subjected to repeated cycles of expansion and contraction, the known response to increases in ambient temperatures, for example, is a corresponding rise in pressure within the system. When the increase in pressure within the system exceeds system design parameters, a breach is inevitable. If the pressure increase is rapid, an explosion is possible, and depending on the gaseous medium, a destructive, and ecologically disastrous result is the probable consequence. Ammonia is potentially explosive.

The relief function of the present invention is accomplished by a controlled purge of excess system pressure, combined with imposition of a refrigeration effect on the remaining liquid before a serious condition becomes unmanageable.

Unlike the code mandated relief system represented by pressure relief valve 10, and the vent system 12, which may respond too late, or too little, and in any event discharges potentially noxious gasses to the atmosphere, the present invention has a measured response to specific conditions, and does not vent environmentally unacceptable gasses to the atmosphere.

Figures 2, 3, 4:
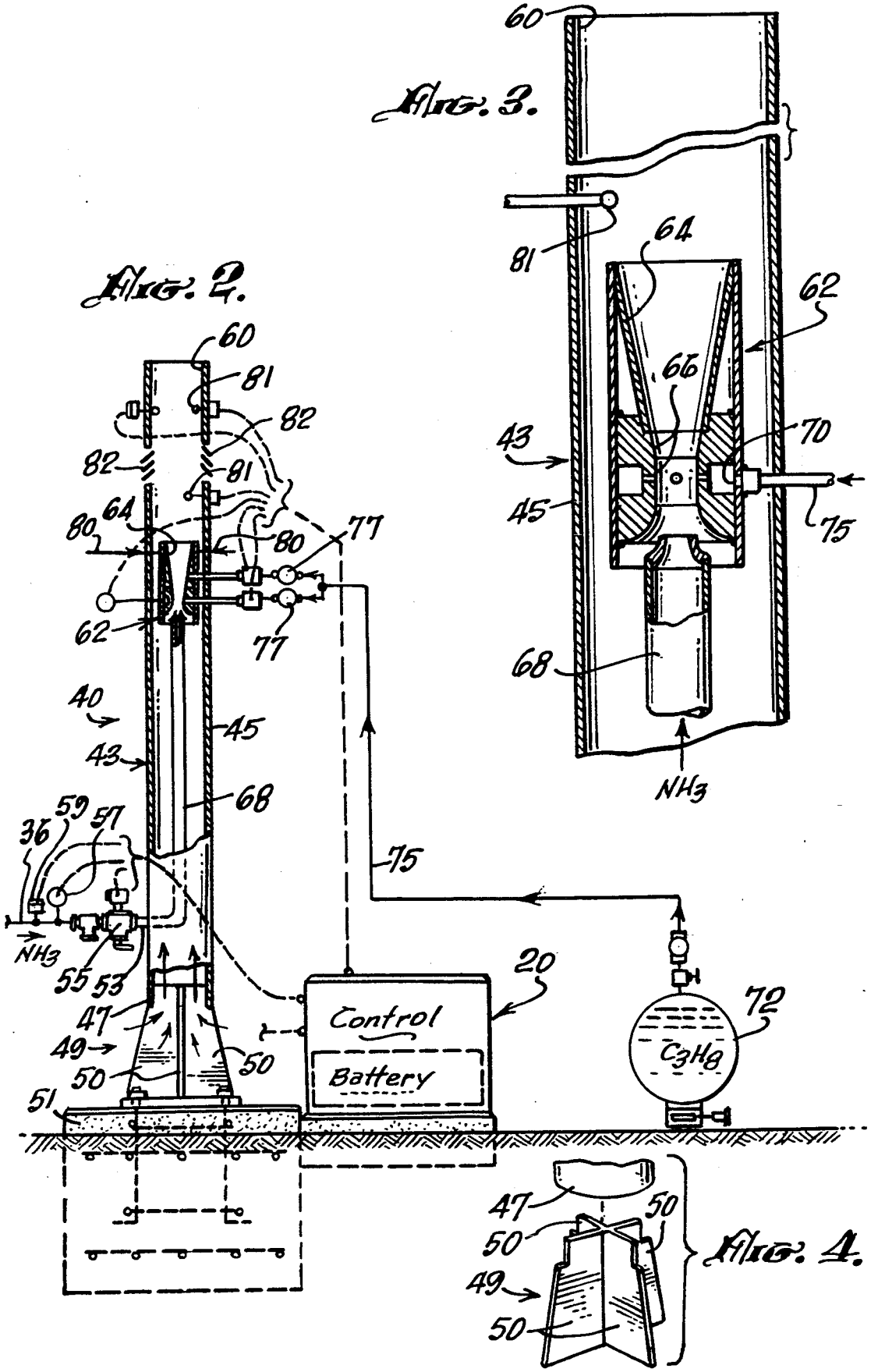
FIG. 2 is a side elevation view of the gas dissipation device of the present invention, partially sectioned to illustrate various features thereof.
FIG. 3 is a sectional view taken along line 3—3.
FIG. 4 illustrates, in perspective, a gas flow control device employed by the system of the present invention.

In keeping with this aspect of the invention, and still referring to FIG. 1, a vent control valve 30 connects to the system pressure vessel S by means of fluid line 32. The vent control valve exhausts through line 34, to vent manifold 36, which carries gasses exhausted from the system S, to an exhaust system 40, the details of which are best seen in FIG. 2, 3 and 4.

In order to provide the measured response to a set of preprogramed parameters, which is the keystone of the present invention, the control unit 20 must open the vent control valve 30 a sufficient amount, for a specific time, in order to alleviate the pressure in the refrigeration system needed to avoid breach of the system.

To this end a mass flow meter 39 is provided in line 32, which is connected to, and communicates with, the control unit 20, to inform the control unit how much system gas is being relieved from the system per unit of time. This value is vital to the proper function of the exhaust system, as will be pointed out in the detailed discussion of that system. The information provided by the mass flow meter is also assimilated with other data in the control system as an adjunct to the overall system monitoring function.

Yet another novel feature of the present invention is the ability to dispose of gasses exhausted from the refrigeration system, to the atmosphere, without appreciable ecological detriment. To this end, the exhaust system 40 includes a vent column assembly 43, comprising a vertically disposed stack 45, affixed, at its lower end 47 to an antivortex vane member 49, which in turn, is secured to a base member 51. The anti-vortex vane member comprises a plurality of radially extending vanes 50, all of which are aligned with the longitudinal axis of the vent column 43. The vane member 49 creates several air passages at the base of the vent column through which combustion air is drawn.

The base member 51 may be anchored, or movable, but is preferably located well outside the environment of the system which it monitors, so as to avoid damage to the exhaust system in the event, for example, of fire or explosion.

As best seen in FIGS. 1 and 2, gasses exhausted or vented into the manifold 36 are introduced into the vent column assembly at port 53, by means of a control valve 55. A mass flow meter 57, and a pressure transducer 59, monitor the system gas exhausted at the control valve 55, thereby informing the control unit 20 of the exact condition of the exhausted gasses being introduced to the vent column assembly 43.

As seen in FIGS. 2 and 4, outside air is introduced into the stack 45 at its lower end 47. Induction air flows across vane member 49, which comprises a series of longitudinally extending vane elements 57, resulting in laminar flow of the induction air as it travels upwardly through the stack 45.

Towards the mouth 60 of the stack 45, a mixer assembly 62 is installed, which includes a venturi unit 64. Exhausted, or vented gasses, as may be seen in the drawings, are introduced slightly upstream of the venturi unit 64 through an induction tube or nozzle 68. The introduction of gasses into the stream flowing upwardly through the stack results in an oxidation/reduction reaction wherein the super heated ammonia vapor discharged from the nozzle results in a partial break down, or decomposition, of the vented gasses into its hydrogen and nitrogen components. As a result, rapid oxidation or burning is enhanced.

The function of the exhaust system 40, beyond the obvious, is to create an efficient flammable mixture, which includes gasses exhausted from the refrigeration system protected by the apparatus of the present invention, and combust the mixture in a manner which will result in nontoxic, ecologically acceptable, byproducts of combustion being dispersed to the atmosphere. While this objective is relatively ease to articulate, it is infinitely more difficult to accomplish. Ammonia, by way of example, while sometimes explosive, is reluctant to combust, and by virtue of the nitrogen molecule present, even tougher to combust in an environmentally acceptable manner.

In keeping with the environmental objectives of the invention, the control unit 20, by constantly monitoring the mass flow of the vented gasses, can, and will constantly adjust induction air so as to create an optimum gas, air, fuel mixture so that combustion is achieved at unexpectedly low temperatures, with a resultant exhaust gas that contains less than 250 ppm of ammonia residue, and extremely low amounts of oxides of nitrogen. The figure of 250 ppm of ammonia residue is an upper limit established nationally as part of an effort to establish environmental parameters for what is referred to as Immediate Danger to Life and Health (IDLH).

In accomplishing the environmentally acceptable dispersion of vented gasses, a flammable, clean burning substance such as natural, or LPG, gas is injected into the system in the throat of the venturi by injectors 70. The injectors are fed from a supply tank 72, through line 73. Gas valves 77, in the line 75 are operated by the control unit 20, which has received information regarding the mass of exhaust gas being introduced, and having stored information regarding the parameters of the venture, and the amount of outside air being introduced, regulates the introduction of hydrocarbon gasses to obtain optimum ignition to sustain efficient combustion.

Immediately downstream of the venturi 654, ignitors 80 are provided to initiate combustion, and flame detectors 81, are placed in the stack 45, in strategic places down stream of the ignitors to signal the control unit that combustion is taking place.

Physical testing of the system herein described has shown that due to the relatively low combustion temperatures and gas velocities, together with resultant low exhaust temperatures, a boundary layer of uncombusted vent gas results above the flame area. To prevent exhaustion of these vented gasses to atmosphere, the invention provides means for disturbing the breaking up that boundary layer.

Specifically, vents are provided in the immediate proximity of the boundary layer, as illustrated, in the form of louvers 82, which expose the exhaust flow to outside air, syphoned into the exhaust flow. The result is that the boundary layer is broken up, and the vented gas is combusted.

The control unit can create conditions necessary for ignition, or shut down the unit, if ignition is not timely or properly achieved. By constantly measuring pressures, mass flows, and related data, gasses exhausted from the monitored system can be efficiently combusted, and the byproducts exhausted to the atmosphere. In the case of an ammonia system, those byproducts include carbon dioxide, some carbon monoxide, nitrogen and water vapor.

The pressure relieved at the system's tank provides an additional benefit in that expansion of the gas takes place across the valve 30, which has a cooling effect on the gasses remaining in the tank, thereby providing an added margin of safety.

It will be appreciated that the exhaust system 40, together with the control unit 20, may be mobile or stationary as the particular application dictates without departure from the essence of the invention.

Having described the invention with respect to a preferred embodiment, what is claimed is:

1. Apparatus for early detection and relief of unsafe conditions in a closed pressurized gaseous storage and transportation system, comprising, in combination:

a plurality of temperature sensing means strategically located throughout the system;

a plurality of pressure sensing means strategically located throughout the system;

a monitor system for receiving information from said temperature and pressure sensing means, and generating a response thereto;

and means for venting and dissipating controlled amounts of system gasses from said system in response to said signal from said monitor system, including:

means for measuring, and conveying to said monitor, the quantity of gasses released from said system at any given time; and means for combusting system gasses so released.

2. The apparatus as set forth in claim 1 wherein said means for combusting system gasses comprises;

means for intermixing said released gasses with combustion air and a flammable hydrocarbon gas, and an ignitor for initiating combustion of said mixture.

3. The apparatus as set forth in claim 2, wherein said flammable hydrocarbon gas is mixed with said system gasses in a proportion as determined by said monitor to provide an optimum combustible mixture.

4. The apparatus as set forth in claim 3, wherein the byproducts of said combusted gasses meets all applicable standards for the discharge of $NO_x$ and $NH_3$.

5. The apparatus as set forth in claim 1, wherein means is provided for restricting the combustion to a specific locale.

6. The apparatus as set forth in claim 5, wherein said means for restricting combustion comprises an exhaust system, said exhaust system including a vertically disposed stack, said stack being connected to said means for venting and dissipating system gasses for receipt and mixing said gasses.

7. The apparatus as set forth in claim 6, wherein a source for flammable hydrocarbon gas is connected to said stack, a control valve interposed between said source of hydrocarbon gas and said stack, and control valve being interconnected with and operated by said monitor to introduce hydrocarbon gas into said stack in proportion to the quantity of released gasses being introduced.

8. The apparatus as set forth in claim 7, wherein the byproducts of said combusted gasses meets all applicable standards for the discharge of $NO_x$ and $NH_3$.

9. The apparatus as set forth in claim 7, wherein said ignitor means is disposed in said stack at a point above the point at which all of said gasses are intermixed.

10. The apparatus as set forth in claim 7, wherein said stack includes means for introducing combustion air into said stack, said combustion air being introduced at a rate which results in the laminar flow thereof.

11. The apparatus as set forth in claim 7, wherein said stack includes a mixer assembly for intermixing said released gasses with said combustion air and said hydrocarbon gasses up stream of said ignitor.

12. Apparatus for early detection and relief of unsafe conditions in a closed pressurized gaseous storage and transportation system, comprising, in combination:

a plurality of temperature sensing means strategically located throughout the system;

a plurality of pressure sensing means strategically located throughout the system;

a monitor system for receiving information from said temperature and pressure sensing means and generating a response thereto;

and means for venting and dissipating controlled amounts of system gasses from said system in response to said signal from said monitor system including:

a mass flow meter for measuring and conveying to said monitor, the quantity of gasses released from said system at any given time;

an exhaust system, said exhaust system having a stack for receiving system gasses and combusting them, said stack comprising:

a vertically disposed vent column, a base member for securing said vent column in a vertical orientation, anti-vortex means supportingly interposed between said vent column and said base, said anti-vortex means comprising a series of radially disposed vanes, said vanes extending upwardly into said tubular structure so as to convert turbulence in the air flowing over said blades to laminar flow, a mixer assembly disposed in said stack in the path of the flow of gasses therethrough;

means interconnecting the system and said exhaust system for injecting released system gasses into said mixing chamber to thereby mix said vented gasses with air valve means for introducing flammable hydrocarbons into said vented gas air mixture;

an ignitor disposed downstream of said mixing chamber for igniting gasses passing out of said mixing chamber to combust the same.

13. The apparatus as set forth in claim 12, wherein the byproducts of said combusted gasses meets all applicable standards for the discharge of $NO_x$ and $NH_3$.

14. The apparatus as set forth in claim 12, wherein said vent column is provided with a plurality of louvers above said ignitors to provide additional air to the combusting mixture, resulting in the breakdown of any boundary layer which may form thereat.

* * * * *